United States Patent [19]

Woodings

[11] Patent Number: 4,503,308

[45] Date of Patent: Mar. 5, 1985

[54] APPARATUS FOR PREPARING ROD STOCK FOR FORGING IN MANUFACTURE OF SUCKER RODS

[76] Inventor: Robert T. Woodings, Box W, Mars, Pa. 16046

[21] Appl. No.: 372,965

[22] Filed: Apr. 29, 1982

[51] Int. Cl.[3] ..... H05B 5/00; H05B 6/00

[52] U.S. Cl. ..... 219/10.73; 219/10.69; 219/10.77

[58] Field of Search ..... 219/10.71, 10.57, 10.43, 219/10.41, 10.73, 10.69, 10.75, 10.77

[56] References Cited

U.S. PATENT DOCUMENTS 3,535,485 10/1970 Soworowski ..... 219/10.69

3,988,559 10/1976 Capolongo ..... 219/10.69 X 4,181,845 1/1980 Bolton ..... 219/10.69 X 4,317,978 3/1982 Nebesar ..... 219/10.71

*Primary Examiner*—Roy N. Envall, Jr.

*Assistant Examiner*—M. M. Lateef

*Attorney, Agent, or Firm*—Thomas H. Murray

[57] ABSTRACT

Straightened rods are withdrawn singly from a table by a carousel apparatus and advanced against a stop which is then withdrawn. Solenoid-coil induction-heating apparatus then raises the end of the rod to forging temperature and retains it at such temperature until the forge operator is ready to use it. Apparatus then operates to deliver the rod with heated end to the operator, and to deliver another single rod to the induction-heating apparatus.

2 Claims, 4 Drawing Figures

APPARATUS FOR PREPARING ROD STOCK FOR FORGING IN MANUFACTURE OF SUCKER RODS

BACKGROUND OF THE INVENTION

1. Field of the Invention

This invention relates to an apparatus and method which are of use in the manufacture of sucker rods of the kind used in the oil industry. In particular, the invention relates to the step of preparing an end of a rod for a forging step in the making of such sucker rods.

2. Description of the Prior Art

The overall procedure for starting with steel rods (approximately $\frac{5}{8}$ inch to $1\frac{1}{8}$ inch in diameter and 25 or 30 feet long) and converting them to seleable sucker rods is well known. It involves, at an early stage in the overall procedure (after the straightening of the as-received rods and before the remainder of the process), the forging of the ends of the rod stock to develop such customary features as the elevator button, the wrench square, the pin shoulder, and the pin. Within the present state-of-the-art, the forging step is still done non-automatically; a forgeman grasps a rod which has a suitably-heated end portion and feeds it into an upset forging machine which has a suitable number of passes (different sets of dies), usually about seven in number, into which the rod end must be suitably put, one after another, and in a usual manner of working, the forgeman has access to a foot pedal which causes the forging machine to strike a blow when the pedal is depressed, i.e., whenever the forgeman believes that he has positioned the work suitably in the next pass. With such equipment, the forging process on one end is usually completed in about 10 to 30 seconds.

Prior to the present invention, the usual practice for preparing an end of a rod for forging has involved either heating in a gas-fired furnace or heating with the use of an electrical induction coil of the channel or the horseshoe type. Either practice has disadvantages. One disadvantage which is shared by the known prior art methods and apparatus for preparing the ends of rods for upset forging in the manufacture of sucker rods is this: the equipment works upon the heating of a number of rods at a time, and the rods have a certain residence time in the heating means, with new, cold rods being added to the heating means when hot ones are withdrawn for forging. The equipment produces a heated rod, ready for forging, about very 15 to 20 seconds, and the rod must be used at that time or scrapped. If a rod with a heated end is permitted to cool without being forged, it warps. The known equipment, whether induction heating or gas firing is used, yields an operation which is paced by the heating means, rather than by the forgeman.

The gas-fired furnaces have the disadvantages that they are relatively costly to build and maintain, and that with the present price of natural gas, they are costly to operate. A gas-fired furnace requires rebuilding about every three to five years.

The induction furnaces with a channel or horseshoe coil have the disadvantages, in comparison to this invention, that they are more costly to build. They are also more costly to operate, requiring on the order of twice to four times the amount of electrical power to operate that is needed by an induction-heating apparatus of the solenoid-coil type which is used in accordance with the present invention.

SUMMARY OF THE INVENTION

Straightened rods are withdrawn singly from a table by a carousel apparatus and advanced against a stop which is then withdrawn. Solenoid-coil induction-heating apparatus then raises the end of the rod to forging temperature and retains it at such temperature until the forge operator is ready to use it. Apparatus then operates to deliver the rod with heated end to the operator, and to deliver another single rod to the induction-heating apparatus.

BRIEF DESCRIPTION OF THE DRAWINGS

A complete understanding of the invention may be obtained from the foregoing and following description thereof, taken in conjunction with the accompanying drawings, in which.

DESCRIPTION OF THE PREFERRED EMBODIMENTS

Figure 1:
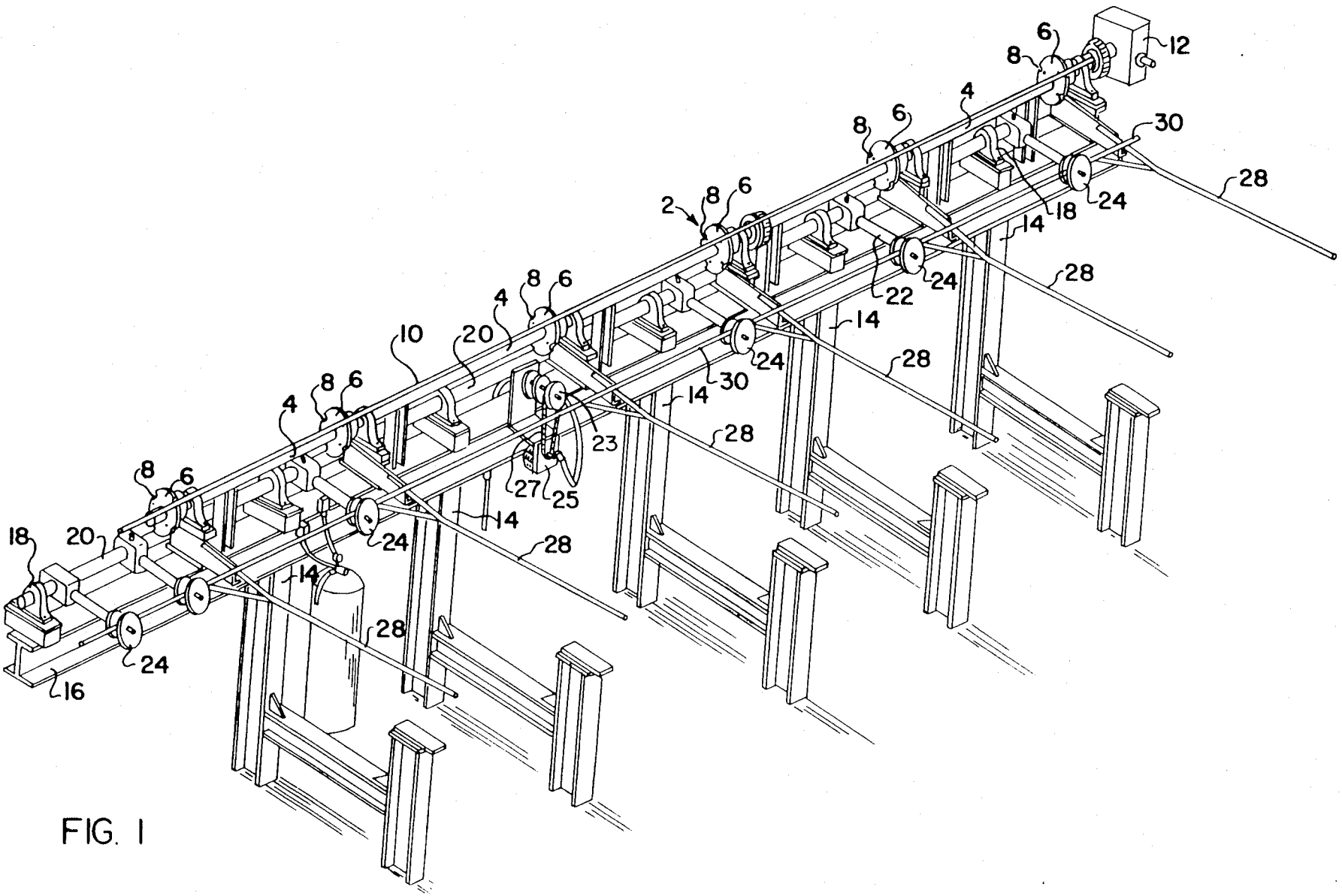
FIG. 1 is a perspective view of rod-handling apparatus used in the practice of the present invention.

One form of rod-handling equipment, preferably used in accordance with the invention, is shown in FIG. 1. From an inclined table (not shown), rods enter a carousel arrangement 2, which comprises a shaft 4 having mounted thereon a plurality of discs 6 which have in their periphery sets of aligned notches 8 which serve to receive a rod, such as rod 10. At suitable intervals of time, means 12 may be operated to cause the shaft 4 to revolve by a suitable angular distance, such as a quarter turn.

Also depicted in FIG. 1 are stanchions 14 which support an I-beam 16, upon which are mounted journals 18 which receive a shaft 20. On the shaft 20 there is mounted a plurality of arms 22 which bear at their ends a plurality of idler rollers 24. As shown a roller 23, in line with rollers 24, is driven by suitable means, such as the motor 25 and chain 27, however, for a purpose to be described below.

The equipment further includes a plurality of support arms 28, the nearer ends of which are slightly lower in elevation than the ends thereof adjacent the I-beam 16, such that if the shaft 20 is revolved to lower the arms 22, a rod such as the rod 30, no longer supported by the rollers 24, will be at liberty to ride down the support arms 28 to the nearer end thereof.

Figure 2:
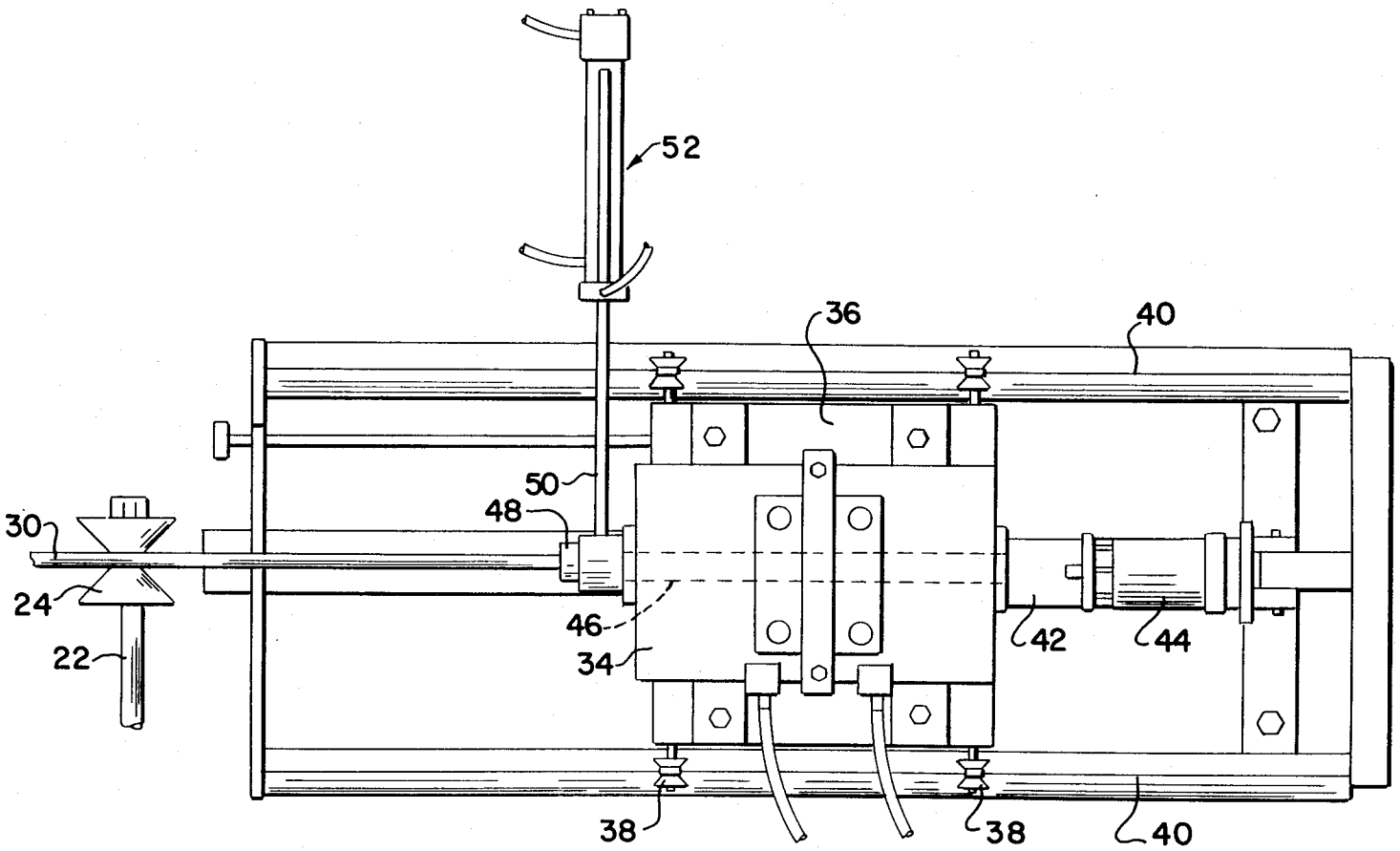
FIG. 2 is a plan view of apparatus for positioning and heating a rod in accordance with the present invention.

Referring now to FIG. 2, there is shown in plan view an additional part of the equipment for use in accordance with the invention. A solenoid-coil type induction furnace 34 is mounted on a carriage 36 which is supported upon rollers 38 for motion along a pair of tracks or rails 40. A cylinder 42 serves to advance on carriage retract the furnace 34 or 36 along the above-mentioned rails or tracks 40. In FIG. 2, the furnace 34 is shown in retracted position. Also shown in FIG. 2 is a sensing means 44 which is aimed, for reasons which will be explained below, at the central cavity 46 of the furnace 34. Also shown in FIG. 2 is a stop 48, shown in its advanced or operative position and supported at the end of a piston rod 50, which is associated with the pneumatic cylinder 52. The cylinder 52 serves to advance and retract the piston rod 50 and the stop 48.

Figure 3:
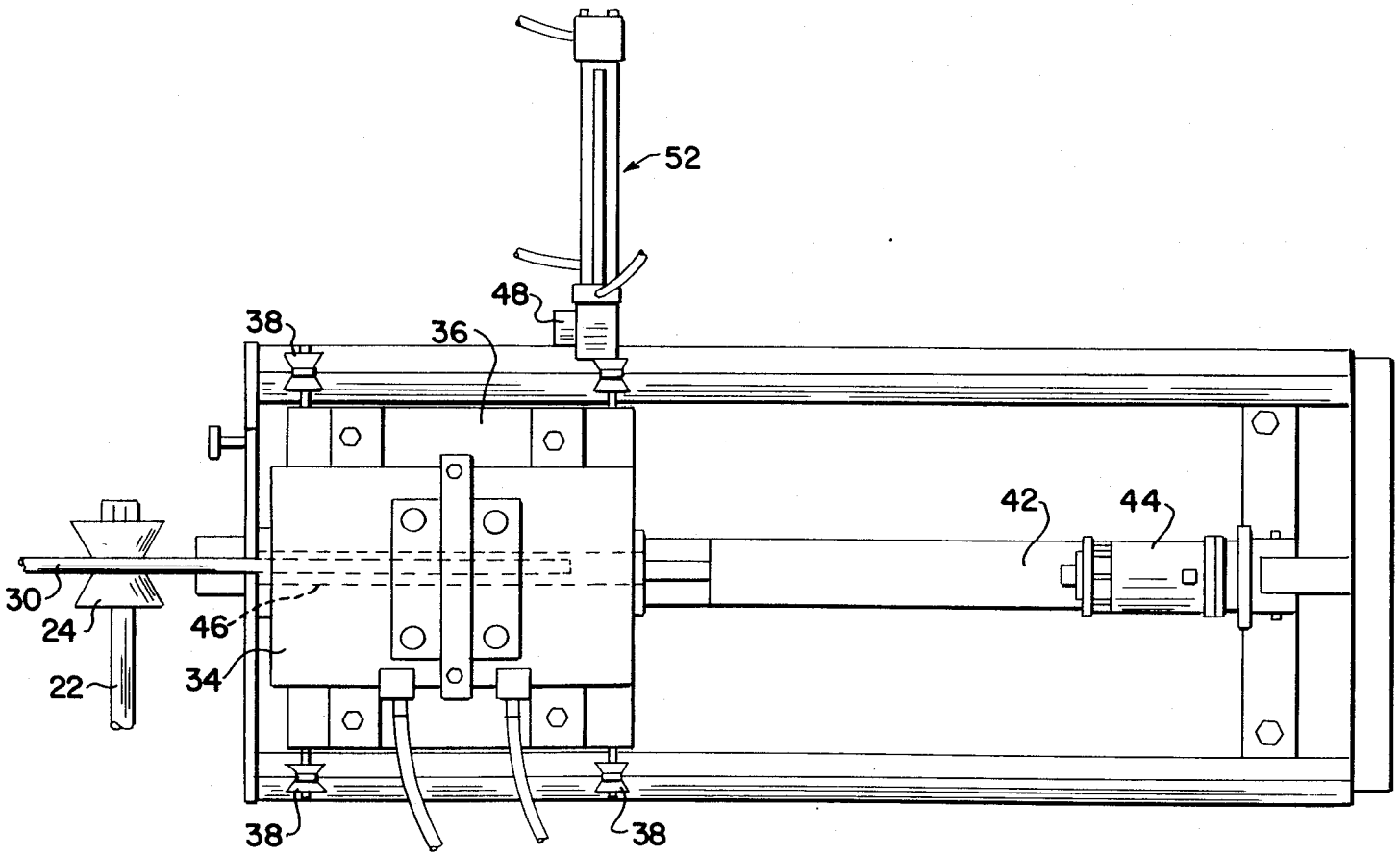
FIG. 3 is likewise a plan view of apparatus for positioning and heating a rod in accordance with the present invention, at a different stage of the method of the present invention.
Figure 4:
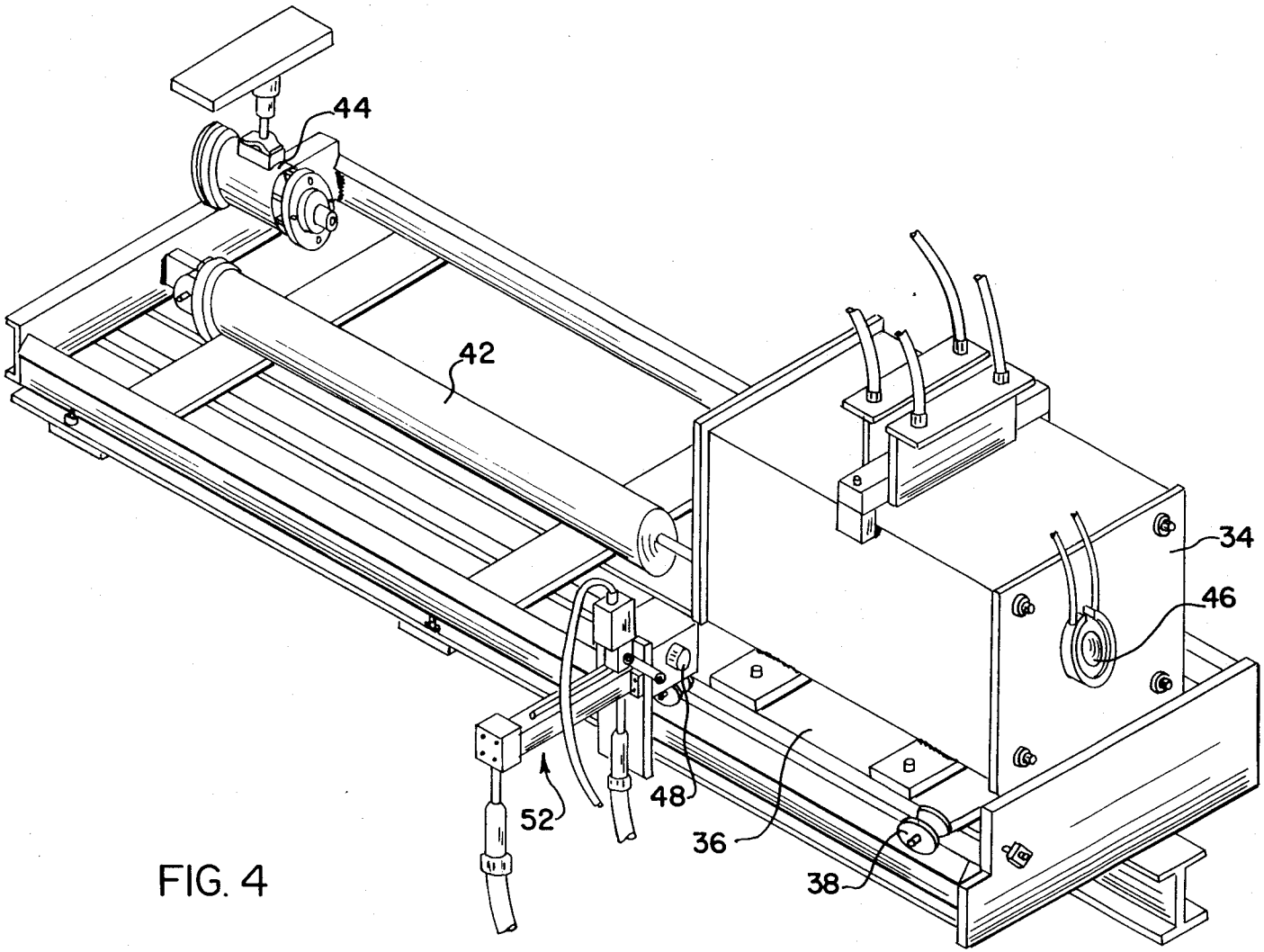
FIG. 4 is a perspective view of a portion of the apparatus depicted in FIG. 3.

Referring to FIGS. 3 and 4, there are depicted substantially the same equipment as shown in FIG. 2, but at a later stage in the processing of a rod to form a sucker rod. More particularly, the furnace 34 is shown in its advanced position and the stop 48 in the retracted position.

OPERATION

Straightened rods are delivered to an inclined table (not shown), from which the lowermost rod is grasped by means of the carousel 2. The carousel is then rotated by the means 12, causing one rod to be moved to the position occupied by the rod 10 in FIG. 1, and causing a rod formerly in that position to be delivered to the rollers 23 and 24. With the equipment of FIGS. 2–4, inclusive, in the position shown in FIG. 2, i.e., with the stop 48 advanced and the furnace 34 retracted, the roller 23 is operated to advance a rod 30 against the stop 48. Then, the cylinder 52 is operated to retract stop 48, and the cylinder 42 is operated to cause the furnace 34 to advance and surround within the central cavity 46 and the rod 30 as shown in FIG. 3. Power is supplied to the furnace 34 to heat the rod end to a suitable temperature, such as about 2250° F. This takes about 15 seconds. The sensing means 44 is aimed at the central cavity 46 of the furnace 34, and it is connected by suitable means (not shown) to the power supply for the furnace 34 so that power is supplied to the furnace 34 sufficiently to retain the end of the rod 30 at the desired forging temperature. A heated rod 30 remains in the furnace 34 until the forgeman is ready to receive a new rod for forging. At that time, the forgeman has finished the forging of the rod and thrusts it behind him where it rests against a stop to prevent it from moving down a table (not shown) which is located, as the forgeman faces his press, behind him and to the left. To forge a new rod, the forgeman depresses a control button (not shown), whereupon the above-mentioned stop which holds the forged rod is lowered, the cylinder 42 operates to move the furnace 34 and its carriage 36 to the retracted position, and a few seconds later, the cylinder 52 operates to advance the stop 48 to its operative position, and the carousel 2 rotates to deliver another rod to the set of rollers 24, which have in the meantime first been lowered to permit the rod with a heated end to roll down the support arms 28 and be grasped by the forgeman and then raised to receive the next rod delivered by the carousel 2. Thereafter, the roller 23 is operated to advance the new rod against the stop 48, and the above-indicated procedure is repeated periodically with the forging of each additional rod.

It will be appreciated that it is possible to operate equipment of the kind indicated above in a manner which is nearly entirely non-automatic. In other words, in one conceivable way of building and operating equipment of the kind described above, the forgeman or a helper for the forgeman faces an array of pushbuttons, which he activates at proper times and in a correct sequence in order to cause the various parts described above to perform their various functions. One button makes the furnace 34 retract to reveal the heated rod. Another lowers the rollers 24. Another advances the stop 48. Another raises the rollers 24. Another causes the carousel apparatus 2 to turn. Another activates the motor 25 to bring the rod against the stop 48. Another retracts the stop 48. Another advances the furnace 34. Another connects the power supply to the furnace 34.

Preferably, however, the equipment is substantially more automatic. To obtain efficient use of the equipment and make it operable with a minimum of labor cost, it is essential that at least some of the above-mentioned operations be made automatic, especially since the forgeman cannot be expected to give attention to such operations as advancing the rod against the stop 48, retracting the stop 48 and advancing the furnace 34 if he is at the same time working with the forging of a rod.

It will also be apparent that the automating of the equipment may be done in any of a number of ways. One suitable scheme is described below.

As has been intimated above, there is a pushbutton for the forgeman to operate to signal that he is prepared to receive a new rod with a heated end for forging. At the moment that the above-mentioned pushbutton is activated, the furnace 34 still surrounds the new rod; the furnace 34 must be retracted. The rollers 24 cannot be lowered until this is done. Thus, in accordance with the scheme being described, activating the pushbutton causes (a) retraction of the stop holding the rod just forged and (b) retraction of the furnace 34. There is at the limit of retraction of furnace 34, a limit switch which then causes (a) the rollers 24 to be lowered and (b) the stop 48 to advance to its operative position. At the bottom of the track of one of the rollers 24, there is a limit switch which causes the rollers 24 to be raised and returned to their previous position, ready to receive another rod for heating. Return of the rollers 24 to their raised position trips another limit switch which causes the carousel apparatus 2 to revolve and deliver a rod to the rollers 24. At the same time, either the same limit switch or one engaged by the rod when it gets into position upon the rollers 24 causes the motor 25 to be activated for a predetermined length of time, one long enough to insure the bringing of the rod upon the rollers 24 against the stop 48. The timer means associated with the motor 25, at the end of the predetermined time interval, turns the motor 25 off and causes the stop 48 to be retracted. As the stop 48 becomes fully retracted, it engages a limit switch which operates to cause the furnace 34 to be advanced and to surround the new rod to be heated. A further limit switch which senses that the furnace 34 has been fully advanced connects the furnace to its power supply. The above scheme is to be considered as illustrative and not in a limiting sense.

It is also worthwhile to observe that in a commercial installation for the manufacture of sucker rods with the use of the present invention, it is desirable to have separate forging presses for the opposite ends of the rods being forged, and this implies that the overall installation includes not one but two sets of equipment of the kind described in detail hereinabove. The conveyor which removes the rods having a first end thereof forged and takes them to the vicinity of the second forging press and its attendant equipment feeds the table from which the carousel equipment near the second forging press receives its rods, with the equipment at the vicinity of the second forging press (press, furnace, stop means, etc.) then essentially being located, when viewed from above, so as to constitute substantially a reversed image of the corresponding equipment at the first station.

Although the invention has been shown and described in connection with a certain specific embodiment, it will be readily apparent to those skilled in the art that various changes in form and arrangement of parts may be made to suit requirements without departing from the spirit and scope of the invention.

I claim as my invention:

1. In an apparatus for heating an end portion of a steel rod preparatory to forging thereof in the manufacture of sucker rods, the combination comprising:

support means for supporting a rod in alignment with an axis;

delivery means for delivering a rod laterally of said axis to said support means;

a stop means which is selectively positionable at an operative position on said axis;

said delivery means comprising carousel means for capturing a first rod while simultaneously delivering a second rod to said support means for advance against said stop means;

rod advancing means for moving the rod along said axis and into endwise engagement with said stop means to position an end portion of the rod for heating thereof;

an induction heater having a heating cavity adapted to receive said rod end portion therewithin;

said induction heater being supported for movement along said axis past the axial location of said stop means toward and away from the rod to selectively encompass said rod end portion within said heating cavity;

means for selectively moving said stop means between said operative position and a clear position laterally removed from said axis to permit said induction heater to be moved therepast;

temperature-sensing means for determining the temperture of said rod end portion within said heating cavity;

means responsive to said temperature-sensing means for selectively supplying power to said induction heater to bring said rod end portion to a desired temperature and to maintain said rod end portion at said desired temperature until needed for forging; and means cooperable with said support means for delivering the rod laterally from said axis upon movement of said induction heater axially away from said rod end portion.

2. The combination as claimed in claim 1 wherein said induction heater is a solenoid-coil heater.

* * * * *